US007832489B2

(12) United States Patent
Assal

(10) Patent No.: US 7,832,489 B2
(45) Date of Patent: Nov. 16, 2010

(54) METHODS AND SYSTEMS FOR COMPLETING A WELL WITH FLUID TIGHT LOWER COMPLETION

(75) Inventor: Anwar Ahmed Maher Assal, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/339,508

(22) Filed: Dec. 19, 2008

(65) Prior Publication Data

US 2009/0159298 A1 Jun. 25, 2009

Related U.S. Application Data

(60) Provisional application No. 61/014,982, filed on Dec. 19, 2007.

(51) Int. Cl.
*E21B 33/12* (2006.01)
*E03B 3/18* (2006.01)

(52) U.S. Cl. ..... 166/386; 166/229; 166/179; 166/158; 166/194

(58) Field of Classification Search ..... 166/227, 166/229, 386, 387, 56, 179, 148, 149, 150, 166/192, 194, 118
See application file for complete search history.

(56) References Cited

U.S. PATENT DOCUMENTS 5,598,890 A * 2/1997 Richard et al. ..... 166/276
5,810,087 A 9/1998 Patel
6,085,845 A 7/2000 Patel et al.
6,227,298 B1 5/2001 Patel
6,302,216 B1 10/2001 Patel
6,352,119 B1 3/2002 Patel
6,516,886 B2 2/2003 Patel
6,550,541 B2 4/2003 Patel
6,659,186 B2 12/2003 Patel
6,662,877 B2 12/2003 Patel
6,945,331 B2 9/2005 Patel
7,108,073 B2 9/2006 Patel
7,231,986 B2 6/2007 Read, Jr. et al.
7,252,142 B2 * 8/2007 Brezinski et al. ..... 166/191
7,337,850 B2 3/2008 Contant
7,347,272 B2 3/2008 Patel et al.
7,404,446 B2 7/2008 Du et al.
2005/0224235 A1 10/2005 Patel
2006/0076149 A1 4/2006 McCalvin
2007/0056745 A1 3/2007 Contant
2008/0283252 A1 * 11/2008 Guignard et al. ..... 166/381
2009/0065192 A1 3/2009 Lucas

* cited by examiner

*Primary Examiner*—Daniel P Stephenson
*Assistant Examiner*—Yong-Suk Ro
(74) *Attorney, Agent, or Firm*—David G. Matthews; Rodney V. Warfford; Kevin B. McGoff

(57) ABSTRACT

An apparatus and method for completing a well. The apparatus can include a packer located downhole of a sand control sliding sleeve extension device to create an upper annulus and a lower annulus. The apparatus can also include a formation isolation well control barrier device located downhole of both the sand control sliding sleeve extension and the packer to create a lower tubular region an upper tubular region.

8 Claims, 3 Drawing Sheets

METHODS AND SYSTEMS FOR COMPLETING A WELL WITH FLUID TIGHT LOWER COMPLETION

CROSS-REFERENCE TO RELATED APPLICATIONS

This application claims priority to U.S. Provisional Patent Application having Ser. No. 61/014,982, filed on Dec. 19, 2007, which is incorporated by reference herein.

BACKGROUND

Hydrocarbon producing formations typically have sand commingled with the hydrocarbons to be produced. For various reasons, it is not desirable to produce the commingled sand to the earth's surface. Thus, sand control completion techniques are used to prevent the production of sand.

A commonly used sand control technique is a gravel pack. Gravel packs typically utilize a screen or the like that is lowered into the borehole and positioned adjacent a hydrocarbon producing zone, which is to be completed. Particulate material, collectively referred to as "gravel," is then pumped as slurry into the borehole through a sand control sliding sleeve extension, which is directly located downhole of the sand control packer. The liquid in the slurry flows into the formation and/or through the openings in the screen resulting in the gravel being deposited in an annulus formed in the borehole between the screen and the borehole. The gravel forms a permeable mass or "pack" between the screen and the producing formation. The gravel pack allows flow of the produced fluids therethrough while substantially blocking the flow of any particulate material, e.g., sand or silt.

Once gravel packing is completed, the excess gravel and proppant (gravel slurry carrier fluid) is reversed out of the service tool and workstring. The service tool is then withdrawn from the lower completion. During withdrawal, to prevent and control production and/or losses from and/or into the formation, a formation isolation well control barrier device closes the flow path up the tubing and a sleeve slides to close off the flow path through the sand control sliding sleeve extension. Thus, the formation is isolated by the formation isolation well control barrier device inside the tubular downhole of the sand screen and by the gravel pack packer uphole of the sand screen. In this system, the sleeve which covers the sand control sliding sleeve extension must also hold back pressure to prevent undesired premature production from the formation. However, in critical applications, such as subsea or deepwater completions, if the sand control sleeve, which is located between the sand control packer and the formation isolation well control barrier device, fails to establish a pressure seal, a well control issue may be introduced. Currently, to partially recover from this challenging situation one may either pump in LCM pills, which may damage the formation, or pump in a huge volume of costly fluids.

There is a desire, therefore, for new systems and methods that reduce or eliminate the possibility for the sleeve covering the sand screen to leak thereby compromising the isolation of the formation.

SUMMARY

Disclosed herein is an apparatus comprising a packer located downhole of the sand control sliding sleeve extension to create an upper annulus and a lower annulus while the formation isolation well control barrier device located downhole of both the sand control sliding sleeve extension and the disclosed herein packer creates a lower tubular region and an upper tubular region.

Also disclosed herein is a method for completing a well comprising placing an annular isolation packer downhole from a sand control device to create an upper annulus and a lower annulus; and placing a formation isolation well control barrier device within a tube of the well downhole from the sand control device to create an upper tubular region and a lower tubular region.

Also disclosed herein is a system for completing a well comprising a sand control sliding sleeve extension device; a sand control packer uphole of the sand control sliding sleeve extension device; a packer located downhole of the sand control sliding sleeve extension device to create an upper annulus and a lower annulus; and a formation isolation well control barrier device located downhole of the sand control device to create a lower tubular region and an upper tubular region.

DETAILED DESCRIPTION

Figure 1:
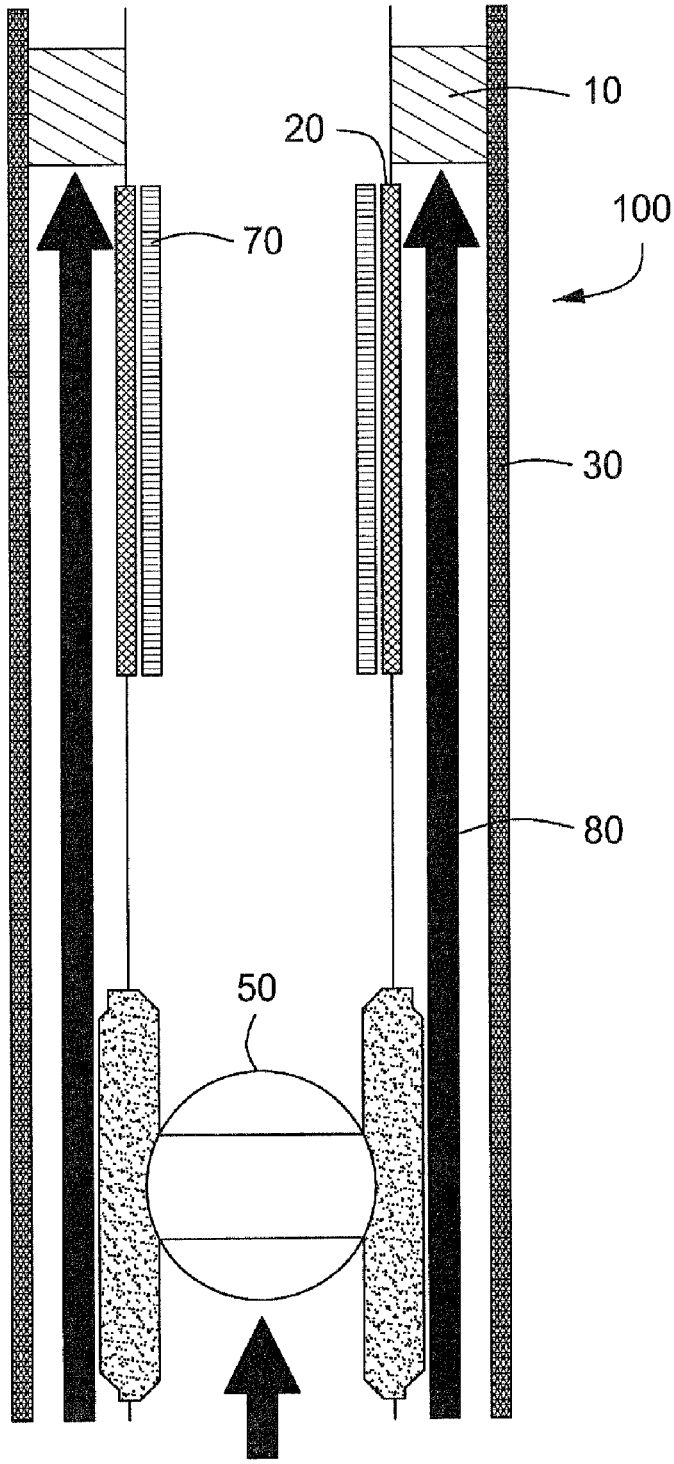
FIG. 1 (PRIOR ART)
FIG. 1 is a schematic drawing of a traditional system.

Referring to FIG. 1, there is shown a traditional configuration of a sand control and formation isolation system 100. Within the system, sand control packers 10 (such as the QMAX packer available from Schlumberger of Houston, Tex.) are set prior to performing a sand control service such as gravel packing or frac packing. A service tool (not shown) may then be run in hole through system 100 to another system further downhole to perform a service on the system that is further downhole. By way of example only, a service tool may be run downhole to perform a gravel pack within a sand control sliding sleeve extension downhole of system 100. An example of an acceptable service tool and method is described in U.S. Published Patent Application 20080128130, incorporated herein by reference. Other services may be performed, such as filter cake removal or fluid spotting as set forth in U.S. Pat. No. 6,725,929, incorporated herein by reference.

Figure 3:
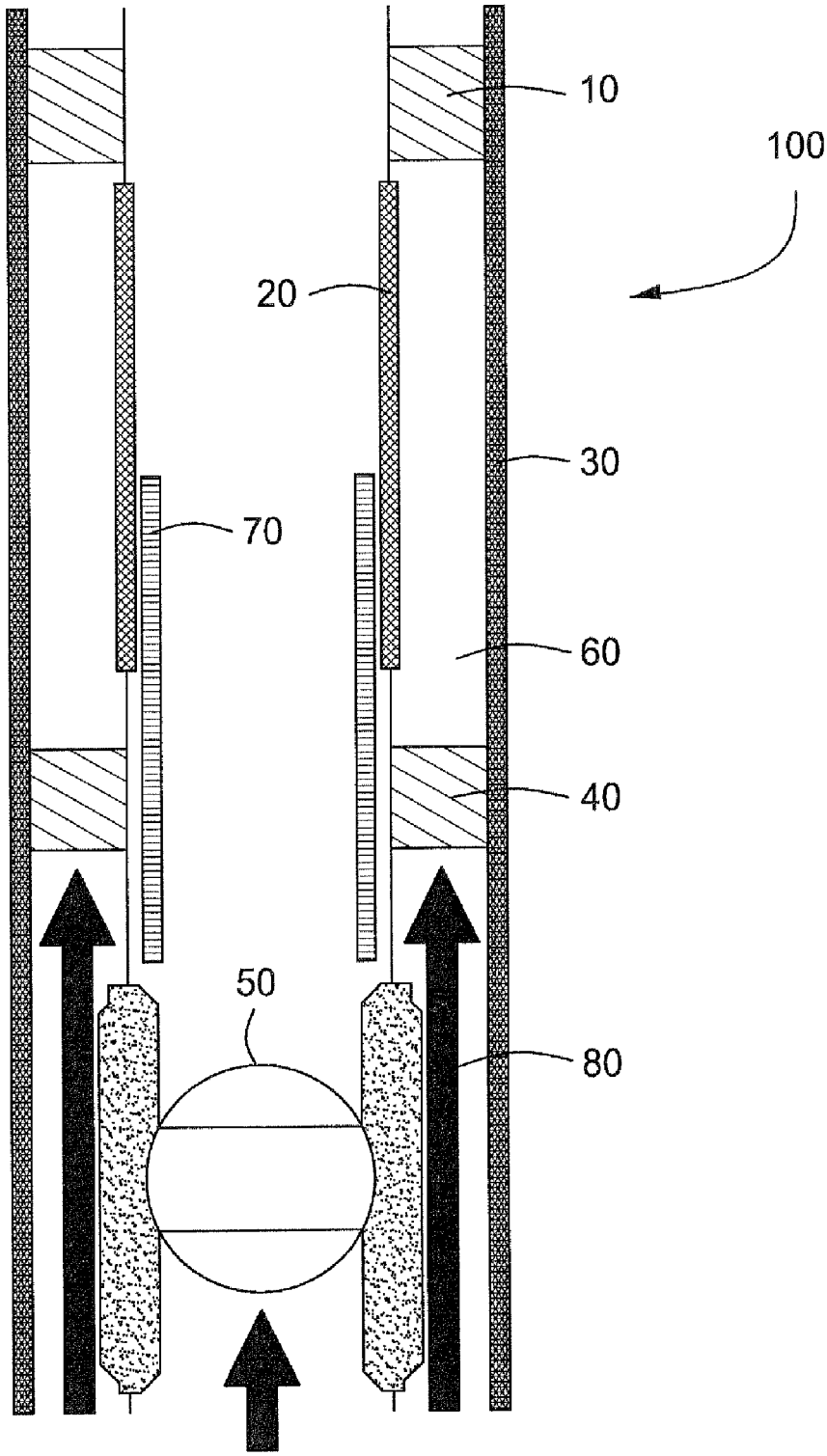
FIG. 3 is a schematic drawing of the system in FIG. 2 depicting the sliding sleeve in an open position.

While pulling out of hole, the service tool may be configured to close isolation valve 50 as well as close sliding sleeve 70 (if sliding sleeve 70 is open as depicted in FIG. 3). When sliding sleeve 70 is closed, fluid 80 is prevented from flowing through sand screen 20. However, if sliding sleeve 70 fails to provide a proper seal, a well control issue may occur, for example, undesired production may occur. A non-limiting example of an acceptable isolation valve is shown in U.S. Pat. No. 5,810,087, incorporated herein by reference.

Figure 2:
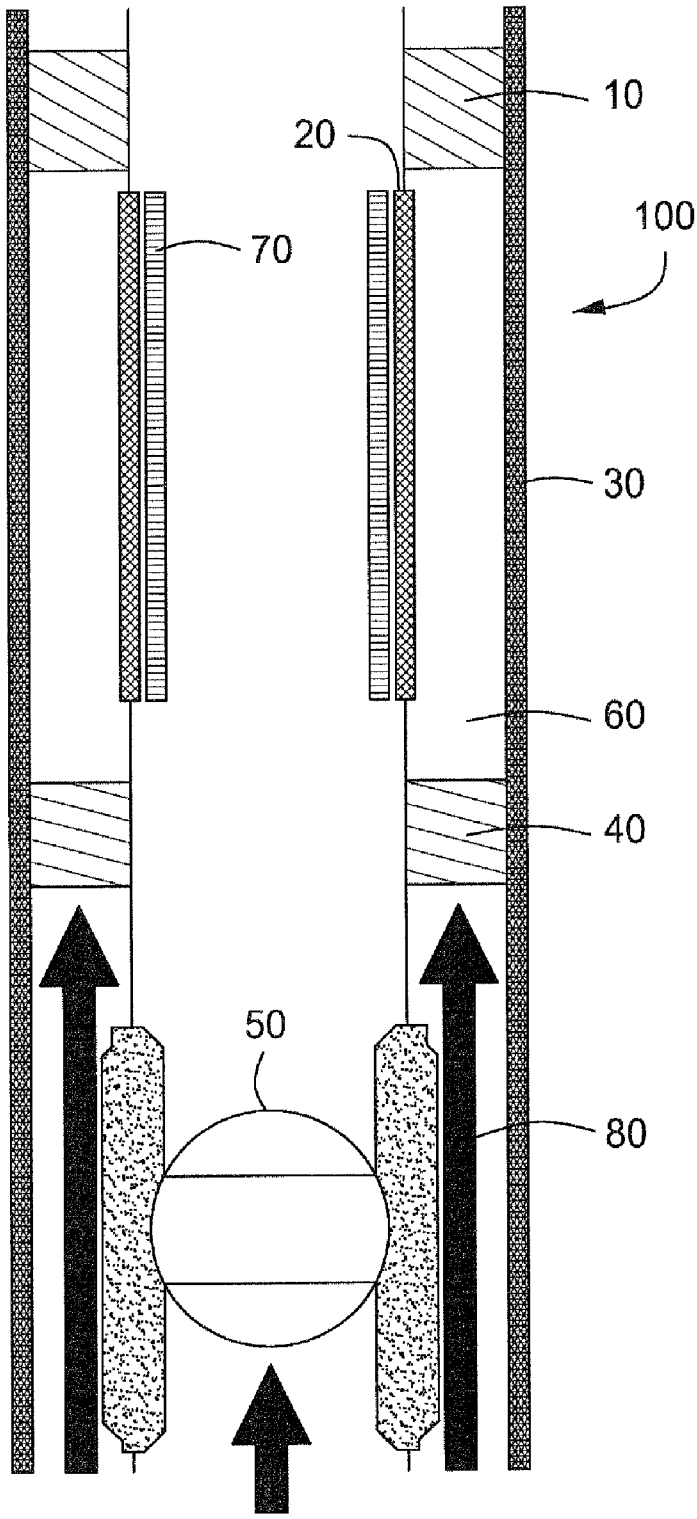
FIG. 2 is a schematic drawing of embodiments of a system as disclosed and claimed herein.

In order to prevent possible well control issues, the embodiments of FIG. 2 include an additional packer 40 located below the sand control sliding sleeve extension to isolate the annular flow path between the casing or open hole 30 and the sand screen 20 and sliding sleeve 70. Any type of packers 10, 40 or sealing methodology such as a swellable packer or an inflatable packer or hydraulic set packer or hydrostatic set, or any other method to close off the annulus 60 may be used (e.g., bridge plugs, valves, sliding sleeves, baffle-plug combinations, or polished bore receptacle seals). As a result, the sand control sliding sleeve 70 may be fully isolated and a gas-tight or oil-tight lower completion may be achieved regardless of whether the sand control sliding sleeve 70 is holding pressure.

In the description above, numerous details are set forth to provide an understanding of the invention. However, it will be understood by those skilled in the art that the present invention may be practiced without these details and that numerous variations or modifications from the described embodiments may be possible.

In the specification and appended claims terms such as uphole and downhole may be used, but, as would be known by one of ordinary skill in the art, uphole and downhole are not limited to horizontal positions. Indeed, uphole and downhole may also describe relative positions with respect to horizontal or otherwise non-vertical wells.

What is claimed is:

1. An apparatus comprising:

a tubular having a longitudinal bore disposed therethrough;

a sand control sliding sleeve extension device disposed on the tubular;

an actuatable sliding sleeve adjacent the sand control sliding sleeve extension device, wherein the actuatable sliding sleeve is adapted to move from a first position that allows fluid flow through the sand control sliding sleeve extension device to a second position that covers the sand control sliding sleeve extension device to prevent fluid flow through the sand control sliding sleeve extension device into the bore of the tubular;

a first annular isolation packer disposed on the exterior of the tubular at a first end of the sand control sliding sleeve extension device;

a second annular isolation packer disposed on the exterior of the tubular at a second end of the sand control sliding sleeve extension device; and a formation isolation well control barrier device disposed within the tubular and adapted to prevent flow therethrough, wherein the second annular isolation packer is disposed between the first annular isolation packer and the formation isolation well control barrier device.

2. The apparatus of claim 1 wherein the first or second annular isolation packer is an inflatable packer.

3. The apparatus of claim 1 wherein the first or second annular isolation packer comprises a swellable material.

4. The apparatus of claim 1 wherein the first or second annular isolation packer is set by compressing an element causing the element to expand radially within the annulus.

5. A method for gravel packing a borehole comprising:

running a sand control system into the borehole, adjacent a hydrocarbon producing zone, the sand control system comprising:

a tubular having a longitudinal bore disposed therethrough;

a sand control sliding sleeve extension device disposed on the tubular;

an actuatable sliding sleeve adjacent the sand control sliding sleeve extension device, wherein the actuatable sliding sleeve is adapted to move from a first position that allows fluid flow through the sand control sliding sleeve extension device to a second position that covers the sand control sliding sleeve extension device to prevent fluid flow through the sand control sliding sleeve extension device into the bore of the tubular;

a first annular isolation packer disposed on the exterior of the tubular at a first end of the sand control sliding sleeve extension device;

a second annular isolation packer disposed on the exterior of the tubular at a second end of the sand control sliding sleeve extension device; and a formation isolation well control barrier device disposed within the tubular and adapted to prevent flow therethrough, wherein the second annular isolation packer is disposed between the first annular isolation packer and the formation isolation well control barrier device, and an annulus is formed between the sand control system and the borehole;

isolating the annulus at a first end of the hydrocarbon producing zone with the first annular isolation packer;

isolating the annulus at a second end of the hydrocarbon producing zone with the second annular isolation packer;

flowing a gravel slurry into the isolated annulus;

returning the fluid from the gravel slurry through the sand control sliding sleeve extension device into the tubular thereby depositing gravel from the gravel slurry in the annulus;

actuating the formation isolation well control barrier device to close off the bore of the tubular; and actuating the actuatable sliding sleeve from its first position to its second position, thereby covering the sand control sliding sleeve extension device to prevent fluid flow from the annulus through the sand control sliding sleeve extension device.

6. The method of claim 5 wherein the first or the second annular isolation packer is an inflatable packer.

7. The method of claim 5 wherein the first or the second annular isolation packer comprises a swellable material.

8. The method of claim 5 wherein the first or the second annular isolation packer is set by compressing an element causing the element to expand radially within the annulus.

* * * * *